US012808282B2

(12) United States Patent
Karakaya et al.

(10) Patent No.: US 12,808,282 B2
(45) Date of Patent: Nov. 24, 2026

(54) CLEANING A VALVE PROFILE IN A WELLHEAD

(71) Applicant: Saudi Arabian Oil Company, Dhahran (SA)

(72) Inventors: Mustafa Karakaya, Dhahran (SA); Sohrat Baki, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 830 days.

(21) Appl. No.: 18/080,174

(22) Filed: Dec. 13, 2022

(65) Prior Publication Data

US 2024/0191600 A1 Jun. 13, 2024

(51) Int. Cl.

| | |
|---|---|
| ***E21B 37/00*** | (2006.01) |
| *E21B 33/04* | (2006.01) |
| *E21B 34/02* | (2006.01) |

(52) U.S. Cl.

CPC ..... *E21B 37/00* (2013.01); *E21B 33/04* (2013.01); *E21B 34/02* (2013.01)

(58) Field of Classification Search

CPC .. B08B 9/00; B08B 9/02; B08B 9/027; B08B 9/04; B08B 9/0436; E21B 37/00; E21B 37/02; E21B 33/04; E21B 33/02; E21B 34/02; E03C 1/302

USPC ..... 15/104.05, 104.063, 104.03

See application file for complete search history.

(56) References Cited

U.S. PATENT DOCUMENTS

| | | | |
|---|---|---|---|
| 2,362,198 | A | 11/1944 | Gibson |
| 4,088,191 | A | 5/1978 | Hutchison |
| 4,301,241 | A | 11/1981 | Saito |
| 4,434,226 | A | 2/1984 | Wilgus et al. |
| 4,601,343 | A | 7/1986 | Lindsey, Jr. et al. |
| 4,660,863 | A | 4/1987 | Bailey et al. |
| 4,739,475 | A | 4/1988 | Mensch |
| 4,754,810 | A | 7/1988 | Bennett et al. |
| 4,755,456 | A | 7/1988 | Sugimoto |
| 4,792,523 | A | 12/1988 | Wong et al. |
| 4,830,109 | A | 5/1989 | Wedel |
| 4,914,014 | A | 4/1990 | Daubendiek et al. |
| 5,279,952 | A | 1/1994 | Wu |
| 5,318,888 | A | 6/1994 | Weberg et al. |
| 5,595,864 | A | 1/1997 | Van den Zegel et al. |
| 5,616,455 | A | 4/1997 | Murphy |
| 5,702,879 | A | 12/1997 | Barcock |
| 5,714,323 | A | 2/1998 | Ohshima et al. |

(Continued)

FOREIGN PATENT DOCUMENTS

WO WO 2007134297 A2 11/2007

OTHER PUBLICATIONS

SAIP Examination Report in Saudi Arabian Appln. No. 123451009, dated Aug. 20, 2025, 11 pages (with English translation).

*Primary Examiner* — Brian D Keller
*Assistant Examiner* — Alberto Saenz
(74) *Attorney, Agent, or Firm* — Fish & Richardson P.C.

(57) ABSTRACT

A back pressure valve (BPV) profile cleaning tool includes a brush assembly configured to attach to a BPV rod of a BPV lubricator tool and a second magnet configured to attach to an end of the BPV rod. The brush assembly includes a brush that includes a plurality of bristles and at least one first magnet. The brush further includes an outer diameter sized for insertion into a BPV profile of a wellhead. The second magnet includes an outer diameter sized to fit through the BPV profile of the wellhead.

24 Claims, 4 Drawing Sheets

(56) References Cited

U.S. PATENT DOCUMENTS 5,743,335 A 4/1998 Bussear
5,785,120 A 7/1998 Smalley et al.
5,827,177 A 10/1998 Oneda et al.
5,829,524 A 11/1998 Flanders et al.
5,856,733 A 1/1999 Matsumoto et al.
5,954,132 A 9/1999 Harris et al.
5,957,195 A 9/1999 Bailey et al.
6,020,708 A 2/2000 Matsumoto et al.
6,039,120 A 3/2000 Wilkins et al.
6,093,554 A 7/2000 Haute et al.
6,105,673 A 8/2000 Harris et al.
6,142,230 A 11/2000 Smalley et al.
6,197,542 B1 3/2001 Haute et al.
6,220,363 B1 4/2001 Dallas
6,302,208 B1 10/2001 Walker et al.
6,523,110 B1 2/2003 Bright et al.
6,558,892 B2 5/2003 Elst et al.
6,587,187 B2 7/2003 Watanabe et al.
6,621,946 B2 9/2003 Yu et al.
6,668,930 B2 12/2003 Hoffman
6,775,894 B2 8/2004 Hardin
6,825,637 B2 11/2004 Kinpara et al.
6,840,325 B2 1/2005 Stephenson
6,848,143 B2 * 2/2005 Schneider ..... B08B 9/021 15/104.03
6,878,549 B1 4/2005 Vogels et al.
7,003,619 B1 2/2006 Moore et al.
7,039,786 B2 5/2006 Suzuki et al.
7,048,125 B2 5/2006 Mize et al.
7,164,999 B2 1/2007 Tabatabaei et al.
7,272,503 B2 9/2007 Strack et al.
7,303,595 B1 12/2007 Janitz
7,308,934 B2 12/2007 Swagerty et al.
7,312,075 B1 12/2007 Yamamura et al.
7,347,840 B2 3/2008 Findlay et al.
PP18,942 P2 6/2008 Boer
PP18,969 P2 6/2008 Boer
7,401,647 B2 7/2008 Baycroft et al.
7,478,679 B2 1/2009 Berzin et al.
7,490,666 B2 2/2009 Swagerty et al.
7,614,448 B2 11/2009 Swagerty et al.
7,615,355 B2 11/2009 Papadopoulos et al.
7,633,992 B1 12/2009 Miao et al.
7,730,940 B2 6/2010 Knippa et al.
7,743,824 B2 6/2010 Lam et al.
7,823,634 B2 11/2010 Chan et al.
7,861,775 B2 1/2011 Palmer et al.
7,900,697 B2 3/2011 Swagerty et al.
7,934,550 B2 5/2011 Bolding et al.
7,954,793 B2 6/2011 Weisbeck et al.
7,997,338 B2 8/2011 Foster et al.
8,087,459 B2 1/2012 Caldwell et al.
8,117,819 B2 2/2012 Scott
8,127,978 B2 3/2012 Castillo et al.
8,136,604 B2 3/2012 Jennings
8,157,006 B2 4/2012 Koleilat et al.
8,194,885 B2 6/2012 Brannmark et al.
8,225,861 B2 7/2012 Foster et al.
8,235,108 B2 8/2012 Lemme et al.
8,251,142 B2 8/2012 Hinkie
8,302,678 B2 11/2012 Swagerty et al.
8,327,943 B2 12/2012 Borak et al.
8,371,374 B2 2/2013 Foster et al.
8,376,043 B2 2/2013 Knobloch et al.
8,396,667 B2 3/2013 Nutley et al.
8,397,802 B2 3/2013 Lembcke
8,499,842 B2 8/2013 Nguyen et al.
8,506,932 B2 8/2013 Arstad et al.
8,550,156 B2 10/2013 Castillo et al.
8,646,533 B2 2/2014 Nguy et al.
8,674,637 B2 3/2014 Kamijo
8,678,406 B1 3/2014 Albertson
8,727,012 B2 5/2014 Bhat
8,794,310 B2 8/2014 Allen et al.
8,823,558 B2 9/2014 Barrett
8,899,316 B2 12/2014 Krawiec et al.
8,910,709 B2 12/2014 Thomson et al.
8,936,075 B2 1/2015 Guidry
9,051,539 B2 6/2015 Synder et al.
9,168,317 B2 10/2015 Jones
9,194,201 B2 11/2015 Simson et al.
9,200,498 B2 12/2015 Klimack
9,243,473 B2 1/2016 Yang et al.
9,284,812 B2 3/2016 Mazyar et al.
9,314,541 B2 4/2016 Jones
9,447,671 B2 9/2016 Nguyen et al.
9,523,256 B2 12/2016 Bilansky et al.
9,587,460 B2 3/2017 Clemens
9,637,997 B2 5/2017 Goodman et al.
9,695,659 B2 7/2017 Davis et al.
9,770,046 B2 9/2017 Negri
9,909,381 B2 3/2018 Kajaria et al.
9,925,825 B1 3/2018 Hoffman et al.
9,976,380 B2 5/2018 Davis et al.
10,060,283 B2 8/2018 Tomigashi et al.
10,132,141 B2 11/2018 Caccialupi et al.
10,159,841 B2 12/2018 Chin et al.
10,173,936 B2 1/2019 Flato et al.
10,230,430 B2 3/2019 Uchino et al.
10,287,846 B2 5/2019 Andersen et al.
10,319,092 B2 6/2019 Wu et al.
10,364,635 B2 7/2019 Puccio et al.
10,447,070 B2 10/2019 Qin et al.
10,450,832 B2 10/2019 Hickie
10,487,302 B2 11/2019 Spangenburg et al.
10,487,607 B2 11/2019 Kajaria et al.
10,604,693 B2 3/2020 Kim et al.
10,612,349 B2 4/2020 Clemens
10,633,966 B2 4/2020 Pollak et al.
10,655,423 B2 5/2020 Stein et al.
10,662,762 B2 5/2020 Alnughaimish et al.
10,677,011 B2 6/2020 Al-AbdulJabbar et al.
10,724,344 B2 7/2020 Dietz
10,738,560 B2 8/2020 Duan et al.
10,743,590 B2 8/2020 Moussa et al.
10,753,173 B2 8/2020 Voll et al.
10,780,659 B2 9/2020 Ahrenholtz
RE48,308 E 11/2020 Flato et al.
10,837,264 B2 11/2020 Filippov et al.
10,893,527 B2 1/2021 Lee et al.
10,947,813 B2 3/2021 Ejim et al.
10,966,224 B2 3/2021 Yu et al.
10,982,499 B2 4/2021 Alshuraim
11,041,357 B2 6/2021 Pounds
11,053,769 B2 7/2021 Craycraft
11,058,837 B2 7/2021 Stam et al.
11,096,194 B2 8/2021 Tang
11,142,732 B2 10/2021 Spangenburg et al.
11,174,700 B2 11/2021 Fripp et al.
11,193,357 B2 12/2021 Clemens
11,268,342 B2 3/2022 Andersen et al.
11,293,270 B2 4/2022 Malone et al.
11,299,955 B2 4/2022 Fripp et al.
11,365,599 B2 6/2022 Glaesman
11,437,156 B2 9/2022 Russell, II et al.
11,440,521 B2 9/2022 Thiel
2002/0119942 A1 8/2002 Vogels et al.
2003/0100100 A1 5/2003 Jacobs, Jr. et al.
2003/0157095 A1 8/2003 Papadopoulos et al.
2004/0210790 A1 10/2004 Moon et al.
2005/0074885 A1 4/2005 Vogels et al.
2005/0205251 A1 * 9/2005 Tulloch ..... E21B 37/02 166/173
2005/0274524 A1 * 12/2005 Silguero ..... E21B 37/00 166/66.5
2006/0106202 A1 5/2006 Papadopoulos et al.
2006/0238437 A1 10/2006 Huang
2007/0261855 A1 11/2007 Brunet et al.
2008/0177592 A1 7/2008 Masuyama et al.
2008/0254372 A1 10/2008 Wu
2008/0254373 A1 10/2008 Wu
2010/0015114 A1 1/2010 Papadopoulos et al.
2010/0068779 A1 3/2010 Wells et al.

(56) References Cited

U.S. PATENT DOCUMENTS

2010/0186962 A1* 7/2010 Knobloch ..... E21B 37/02 166/170
2010/0258311 A1 10/2010 Craig et al.
2011/0081295 A1 4/2011 Papadopoulos et al.
2012/0012343 A1 1/2012 Wilkin et al.
2012/0024521 A1 2/2012 Villa
2013/0105388 A1 5/2013 Johnson et al.
2013/0288228 A1 10/2013 Anderson et al.
2014/0058677 A1 2/2014 Combee
2015/0012664 A1 1/2015 Johnson
2015/0041126 A1 2/2015 Boyle et al.
2015/0041129 A1 2/2015 Mani et al.
2015/0073523 A1 3/2015 Chobotov
2015/0090255 A1 4/2015 Gulliver et al.
2015/0278138 A1 10/2015 Seidel et al.
2015/0347246 A1 12/2015 Matsui et al.
2015/0378937 A1 12/2015 Yang et al.
2018/0124634 A1 5/2018 Jose et al.
2018/0171740 A1 6/2018 Casanova
2018/0313182 A1 11/2018 Cherewyk et al.
2019/0055839 A1 2/2019 Skillingstad et al.
2019/0321264 A1 10/2019 Gulliver et al.
2020/0003032 A1 1/2020 Chen et al.
2020/0375265 A1 12/2020 Moussa et al.
2021/0108478 A1 4/2021 Filippov et al.
2021/0108490 A1 4/2021 Filippov et al.
2021/0115746 A1* 4/2021 Atkins ..... E21B 21/002
2021/0324699 A1 10/2021 Trumbull et al.
2021/0370000 A1 12/2021 Stam et al.
2022/0068512 A1 3/2022 Russell, II et al.
2022/0081986 A1 3/2022 Roselier et al.
2022/0081989 A1 3/2022 Muballa et al.
2022/0086848 A1 3/2022 Sharma et al.
2022/0120155 A1 4/2022 Firth et al.
2022/0299151 A1 9/2022 Lee et al.

* cited by examiner

CLEANING A VALVE PROFILE IN A WELLHEAD

TECHNICAL FIELD

The present disclosure describes systems and methods for cleaning a valve profile in a wellhead, such as a back-pressure valve profile.

BACKGROUND

A back-pressure valve (BPV) is a type of a check valve, which is installed in a tubing hanger BPV profile to isolate an upper wellhead section of production tubing/casing from pressure below. The BPV is designed to hold pressure from below by isolating well pressure, while allowing for a one-way flow path to pump fluid from above in case a well control issue occurs as part of killing a well with kill fluid. The BPV is typically used during isolation of the well as a barrier and during temporary isolation such as replacement of the "Christmas tree" or master valves.

During exploitation of the well over time, a BPV profile can accumulate with some solids, debris, metal shavings, and scale with mixture of viscous fluid or grease, especially during production, well intervention or wellhead greasing operations period. Should such debris not be cleaned properly, a BPV can be prevented from being set into a BPV profile or generate challenges to retrieving the BPV from BPV position. In some cases, a BPV can end up being stuck at the wellhead.

SUMMARY

In an example implementation, a back pressure valve (BPV) profile cleaning tool includes a brush assembly configured to attach to a BPV rod of a BPV lubricator tool and a second magnet configured to attach to an end of the BPV rod. The brush assembly includes a brush that includes a plurality of bristles and at least one first magnet. The brush further includes an outer diameter sized for insertion into a BPV profile of a wellhead The second magnet includes an outer diameter sized to fit through the BPV profile of the wellhead.

In an aspect combinable with the example implementation, the at least one first magnet includes a plurality of first magnets.

In another aspect combinable with any of the previous aspects, the plurality of first magnets include a plurality of ring magnets mounted on the BPV rod or the to the brush assembly.

In another aspect combinable with any of the previous aspects, the at least one first magnet is configured to attract metallic debris detached from the BPV profile by the brush.

In another aspect combinable with any of the previous aspects, the plurality of bristles are metallic bristles.

In another aspect combinable with any of the previous aspects, the second magnet is configured to attract at least some of the metallic debris detached from the BPV profile by the brush or bristle pieces broken off from at least one of the plurality of metallic bristles.

In another aspect combinable with any of the previous aspects, the second magnet is configured to threadingly attach to the end of the BPV rod.

In another aspect combinable with any of the previous aspects, the outer diameter of the second magnet is less than an outer diameter of a BPV configured to couple to the BPV profile.

In another aspect combinable with any of the previous aspects, the brush assembly and the second magnet are configured to couple to the BPV rod with one or more threaded connections.

In another example implementation, a method for cleaning a BPV profile of a wellhead includes running a BPV lubricator tool into a wellhead. The BPV lubricator tool includes a brush assembly attached to a BPV rod of the BPV lubricator tool and including: a brush that includes a plurality of bristles and an outer diameter sized for insertion into a BPV profile of the wellhead, and at least one first magnet; and a second magnet attached to the end of the BPV rod. The method further includes adjusting a length of the BPV rod to land the brush assembly into a BPV profile of the wellhead; operating the BPV rod to move the brush assembly within the BPV profile such that the plurality of bristles repeatedly contact a surface of the BPV profile; and during the contact, removing one or more debris from the surface of the BPV profile with the plurality bristles.

An aspect combinable with the example implementation further includes magnetically attracting the one or more debris to the at least one magnet of the second magnet.

In another aspect combinable with any of the previous aspects, the plurality of bristles are metallic, the method further including magnetically attracting pieces of the metallic bristles broken off during the contact with the BPV profile to the second magnet.

In another aspect combinable with any of the previous aspects, operating the BPV rod to move the brush assembly includes at least one of operating the BPV rod to rotate the brush assembly within the BPV profile such that the plurality of bristles repeatedly contact the surface of the BPV profile; or operating the BPV rod to reciprocate the brush assembly within the BPV profile such that the plurality of bristles repeatedly contact the surface of the BPV profile.

Another aspect combinable with any of the previous aspects further includes, subsequent to removing the one or more debris from the surface of the BPV profile with the plurality bristles: running the BPV lubricator tool out of the wellhead; replacing the brush assembly and the second magnet attached to the end of the BPV rod with a BPV; running the BPV lubricator tool back into the wellhead; and installing the BPV into the BPV profile with the BPV lubricator tool.

In another aspect combinable with any of the previous aspects, replacing the brush assembly and the second magnet attached to the end of the BPV rod with the BPV includes unthreading the brush assembly and the second magnet from the end of the BPV rod; and threading the BPV onto the end of the BPV rod.

Another aspect combinable with any of the previous aspects further includes, subsequent to installing the BPV into the BPV profile with the BPV lubricator tool, removing the BPV lubricator tool from the wellhead.

In another example implementation, a downhole tool assembly includes a back pressure valve (BPV) lubricator tool that includes a BPV rod; and a BPV profile cleaning tool. The BPV profile cleaning tool includes a brush assembly attached to the BPV rod that includes a brush that includes a plurality of bristles and an outer diameter sized for insertion into a BPV profile of a wellhead, and at least one first magnet. The BPV profile cleaning tool includes a second magnet configured to attach to an end of the BPV rod, the second magnet including an outer diameter sized to fit through the BPV profile of the wellhead.

In an aspect combinable with the example implementation, the at least one first magnet includes a plurality of first magnets.

In another aspect combinable with any of the previous aspects, the plurality of first magnets include a plurality of ring magnets mounted on the BPV rod or the to the brush assembly.

In another aspect combinable with any of the previous aspects, the at least one first magnet is configured to attract metallic debris detached from the BPV profile by the brush.

In another aspect combinable with any of the previous aspects, the plurality of bristles are metallic bristles.

In another aspect combinable with any of the previous aspects, the second magnet is configured to attract at least some of the metallic debris detached from the BPV profile by the brush or bristle pieces broken off from at least one of the plurality of metallic bristles.

In another aspect combinable with any of the previous aspects, the brush assembly and the second magnet are configured to threadingly attach to the end of the BPV rod.

In another aspect combinable with any of the previous aspects, the outer diameter of the second magnet is less than an outer diameter of a BPV configured to couple to the BPV profile.

Implementations of systems and methods for cleaning a back pressure valve (BPV) profile according to the present disclosure can include one, some, or all of the following features. For example, example implementations of a BPV profile cleaning assembly according to the present disclosure can be integrated or otherwise connected to a conventional BPV lubricator tool for installation into a wellhead. As another example, example implementations of a BPV profile cleaning assembly according to the present disclosure can effectively clean a BPV profile area prior to setting a BPV therein to facilitate a successful BPV installation and isolation of the well and avoid potential stuck operations. Further, example implementations of a BPV profile cleaning assembly according to the present disclosure can operate in a high pressure situation. Further, example implementations of a BPV profile cleaning assembly according to the present disclosure can also provide the following features: eliminate slickline intervention operations to clean a BPV profile; eliminate coil tubing intervention operations to clean a BPV profile; elimination of workover/drilling rig intervention operations to clean a BPV profile; establish a clean and ready to set BPV profile to accommodate isolation barriers at the wellhead; eliminate possible stuck BPV operations inside of a tubing hanger so that wellhead production tree valves can be closed and function properly; and magnetically attract debris with one or more magnets to facilitate removal from the wellhead.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
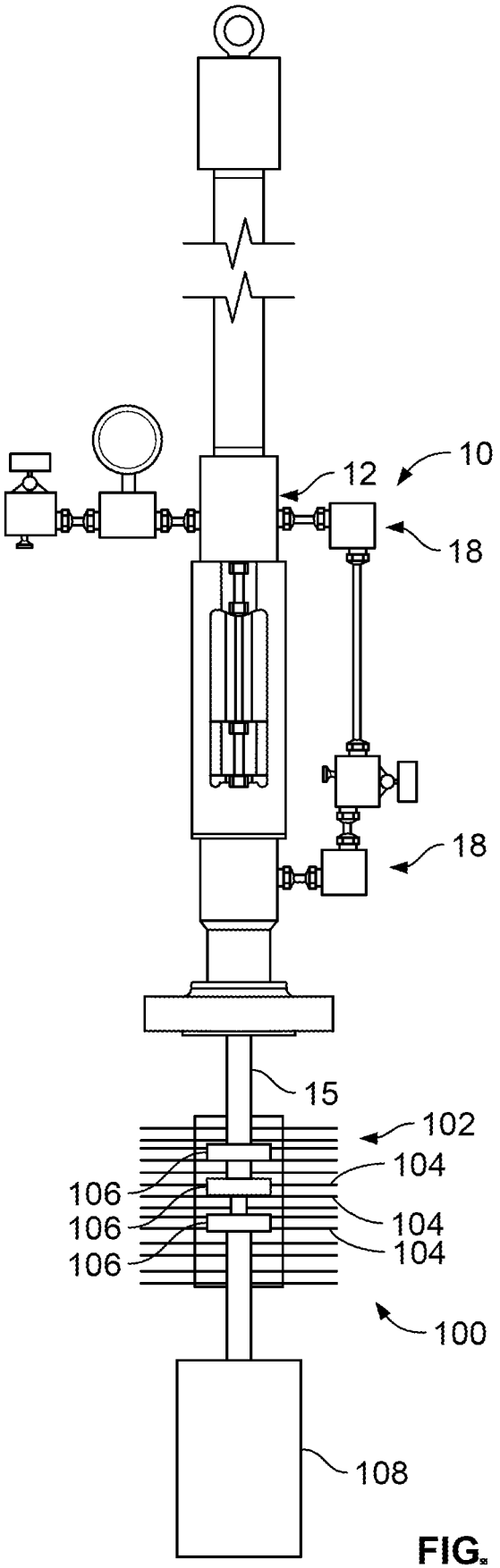
FIG. 1 is a schematic drawing of an example implementation of a back pressure valve (BPV) lubrication tool with a BPV profile cleaning assembly according to the present disclosure.

FIG. 1 is a schematic drawing of an example implementation of a back pressure valve (BPV) lubrication tool 10 with a BPV profile cleaning assembly 100 according to the present disclosure. Generally, BPV lubrication tool 10 comprises a conventional or traditional BPV lubrication tool in that BPV lubrication tool 10 can be run into (or stung into) into a wellhead to install a back pressure valve (shown in FIG. 2 as back pressure valve 200) into a tubing hanger profile, also called a back pressure valve profile in some aspects. A "profile" according to the present disclosure, can comprise a surface (often circular or round in some aspects) into which a valve can be set, threaded, landed, or otherwise installed. Upon installation in the profile of the wellhead, a back pressure valve can be used to fluidly separate a portion of the wellhead downhole of the back pressure valve from another portion of the wellhead uphole of the back pressure valve. The back pressure valve can also allow for one way (downhole) fluid flow, for example, in wellbore kill operations.

In some aspects, however, the profile in the tubing hanger into which the back pressure valve is installed can accumulate with some solids, debris, metal shavings, scale with mixture of viscous fluid or grease, especially during production, well intervention or wellhead greasing operations period. Accumulated solid, metal shavings, junk and debris across the BPV profile can cause the BPV, itself, to become stuck (and, for instance, irremovable).

As shown in FIG. 1, the BPV profile cleaning assembly 100 is mounted on a BPV rod 15 of the BPV lubrication tool 10. The BPV lubrication tool 10 includes, among other conventional components, the BPV rod 15, a running and retrieving tool 12 that has pressure equalization ports and valves 18 to allow for a flow of pressurized fluid through the tool 12 to provide for movement of the BPV rod 15. BPV rod 15, for instance, in this example, can move by rotating or spinning, as well as reciprocating to extend from and into the running and retrieving tool 12. Typically, such movement of the BPV rod 15 and operation of the running and retrieving tool 12 is used to install a BPV into a BPV profile of a wellhead.

Figure 2:
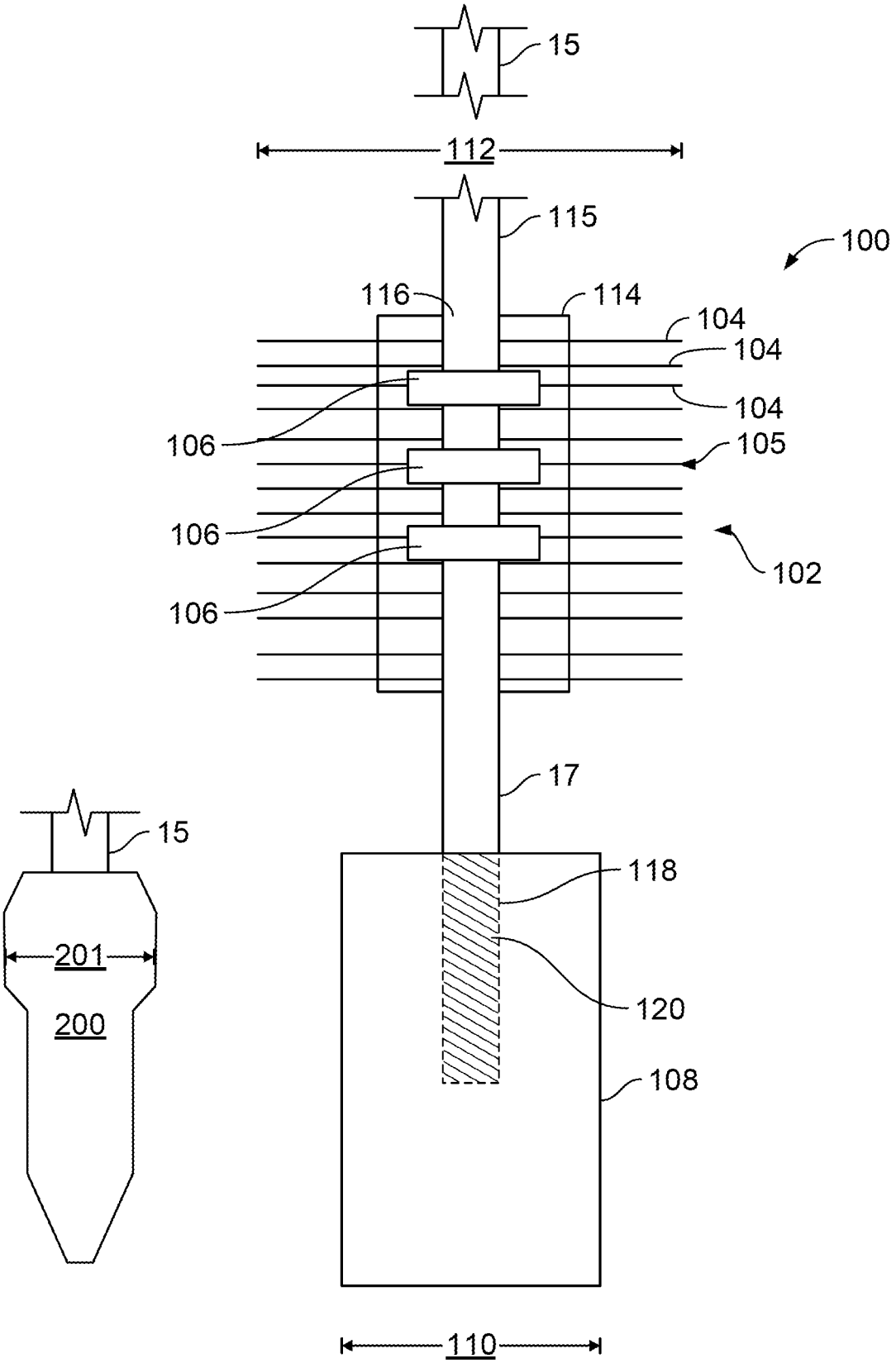
FIG. 2 is a schematic drawing of at least a portion of an example implementation of a BPV profile cleaning assembly according to the present disclosure.

In some aspects, and as shown in FIG. 2, the BPV profile cleaning assembly 100 can include a mounting rod 115 that is separate from the BPV rod 15 and can be connected to the BPV rod 15. Thus, in some aspects, the BPV profile cleaning assembly 100 is an integrated assembly that includes the mounting rod 115 that is then connected (threadingly or otherwise) to the BPV rod 15 to facilitate efficient installation. Thus, in some aspects, the end 17 represents the end of the mounting rod 115 rather than the end of the BPV rod 15. But alternatively, the components of the BPV profile cleaning assembly 100, such as the brush assembly 102 and the magnet 108, can be mounted directly on the BPV rod 15 (such that the mounting rod 115 represents a portion of the BPV rod 15).

As shown in this example implementation, the BPV profile cleaning assembly 100 includes a brush assembly 102 that is mounted (for example, threadingly, or otherwise)

on a portion of the BPV rod 15. The BPV profile cleaning assembly 100 also includes a magnet 108 (which can, in some aspects, be comprised of multiple magnets 108) that is positioned on or mounted to an end of the BPV rod 15.

Turning briefly to FIG. 2, the BPV profile cleaning assembly 100 is shown in more detail. For instance, in this example implementation, the brush assembly 102 includes a brush 105 mounted on the BPV rod 15. The brush 105 includes a core 114 that, as shown, includes a bore 116 through which the BPV rod 15 can be installed. The brush 105 also includes bristles 104 connected to the core 114. The bristles 104 can extend from the core 114 to define a diameter 112 of the brush 105, such as radially around the core 114 when the core 114 is cylindrical or substantially cylindrical. However, other shapes of the core 114 are contemplated by the present disclosure, and the diameter 112 may represent an outer dimension of the brush 105 that is not a diameter dimension. In some aspects, the outer diameter 112 of the brush 105 can be larger than an inner diameter of a BPV profile of a wellhead ensuring that, for instance, the bristles 104 maintain contact with the inner surface of the BPV profile during a cleaning operation. In some aspects, the bristles 104 are made of a metallic or otherwise magnetized material, such as steel or other diamagnetic, paramagnetic, ferromagnetic, or permanent magnet material.

The example brush assembly 102 also includes one or more magnets 106. In this example, there are three magnets 106; other example implementations can have more or fewer magnets 106. In some aspects, the magnets 106 are ring magnets (for example, as shown) that are mounted to the BPV rod 15, the core 114, or another part of the brush assembly 102. In some aspects, the magnets 106 can be positioned within or between the bristles 104 of the brush 105 (as shown) to magnetically attract any metal debris that are removed from a BPV profile surface by the bristles 104. In some aspects, the magnets 106 can also magnetically attract any pieces of the bristles 104 that break off, such as during a cleaning operation of a BPV profile surface by the bristles 104.

As further shown in FIG. 2, the BPV profile cleaning assembly 100 also includes a magnet 108 that is positioned on an end 17 of the BPV rod 15. In this example, the magnet 108 includes a bore 118 with threads 120 so that the magnet can be threaded onto the end 17. However, in alternate implementations, the magnet 108 can be attached to the BPV rod 15 (at the end 17 or otherwise) by some other mechanical fashion. As shown, an outer diameter 110 of the magnet 108 can be smaller than an outer dimension 201 of a back pressure valve 200 shown in this figure (not to scale) for reference purposes. For instance, as explained in more detail herein, once the BPV profile cleaning assembly 100 is operated to clean a BPV profile of a wellhead, the magnet 108 (as well as, for example, the brush assembly 102) can be removed from the BPV rod 15 and the back pressure valve 200 can be installed on the end 17 for installation in the BPV profile of the wellhead.

Figure 3:
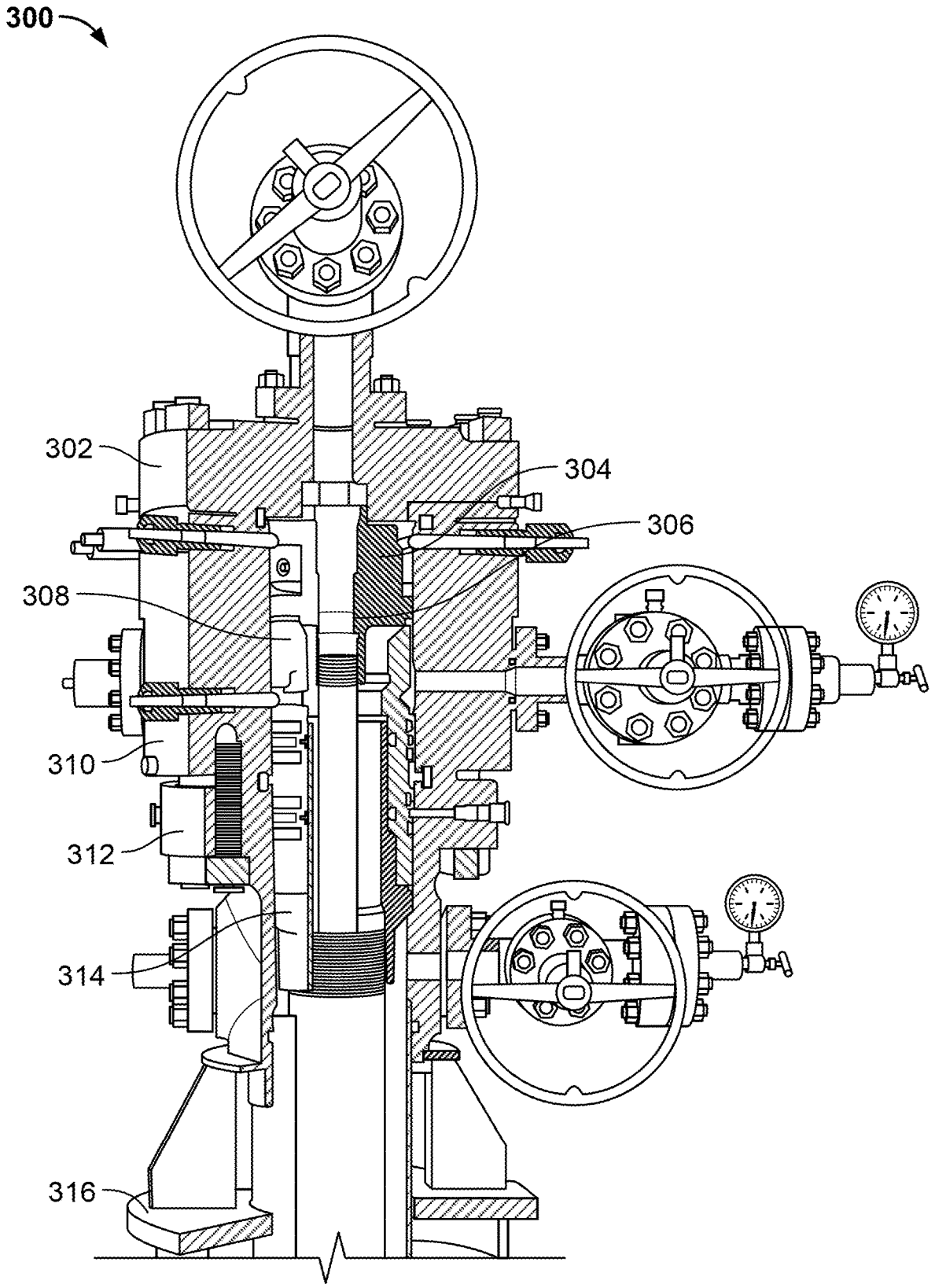
FIG. 3 is a schematic drawing of a portion of a wellhead that includes a tubing hanger and tubing hanger BPV profile into which a BPV profile cleaning assembly according to the present disclosure can be positioned.

FIG. 3 is a schematic drawing of a portion of a wellhead 300 that includes a tubing hanger and tubing hanger BPV profile into which a BPV profile cleaning assembly according to the present disclosure can be positioned. For example, wellhead 300 (or the illustrated portion thereof) can be a convention wellhead that includes, among other components, a tubing head adapter 302, a tubing hanger 304, a tubing hanger profile (or BPV) profile, 306, a pack-off support bushing 308, an upper casing spool 310, a lower casing head 312, a casing hanger 314, and a landing base 316.

With a focus on the tubing hanger 304 and the BPV profile 306, the BPV profile 306 is formed on the inner surface of the tubing hanger 304 as shown and provides a landing seat for a back pressure valve (such as back pressure valve 200). Once landed (for instance, threaded or otherwise) into the BPV profile 305 in the tubing hanger 304, the back pressure valve can provide a seal in which a pressure in the wellhead is maintained downhole of the back pressure valve. Further, wellbore kill fluids can still be circulated from uphole of the back pressure valve into the wellhead 300.

Figure 4:
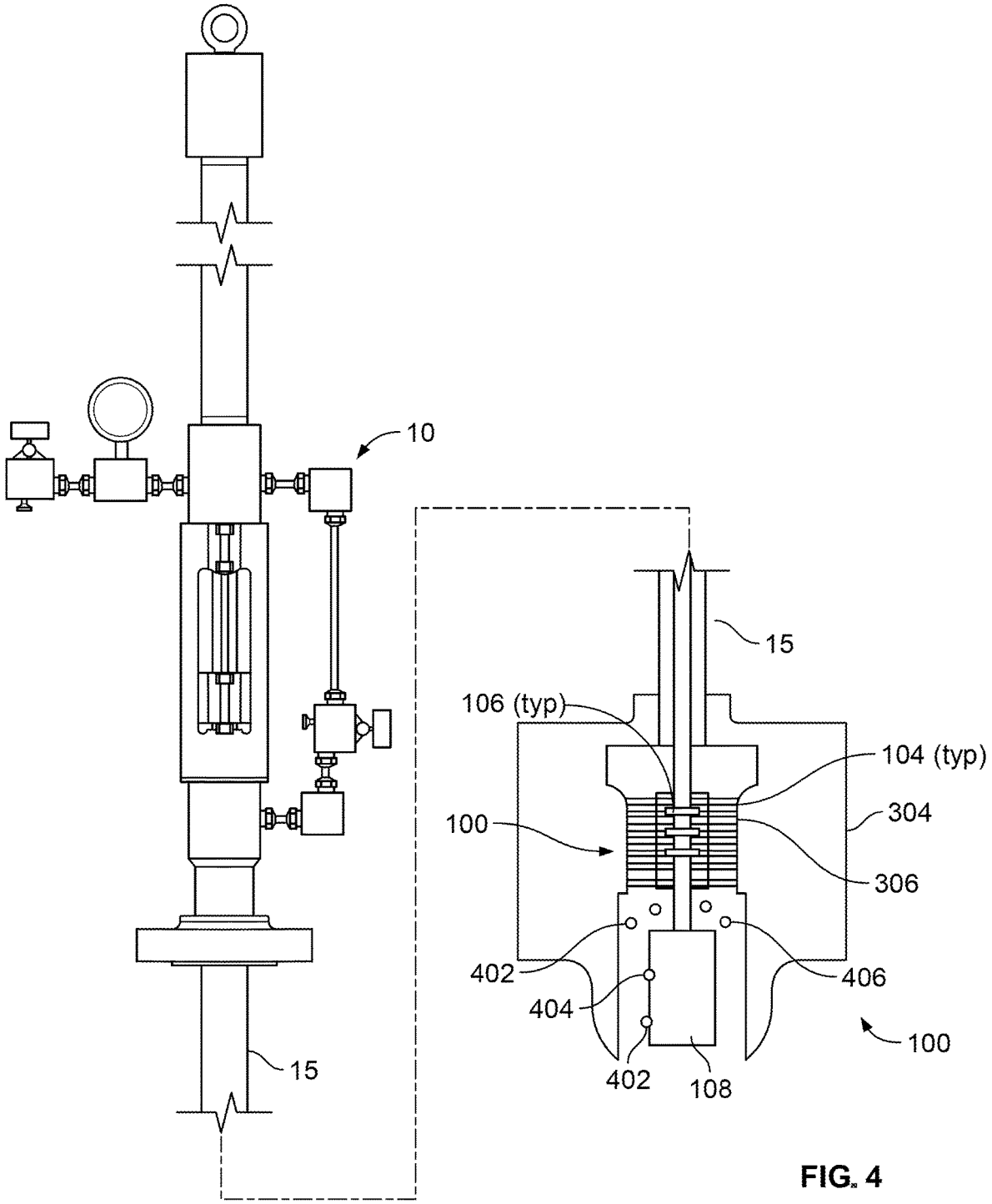
FIG. 4 is a schematic drawing of a portion of an example implementation of a BPV profile cleaning assembly positioned within a tubing hanger BPV profile.

FIG. 4 is a schematic drawing of a portion of an example implementation of the BPV profile cleaning assembly 100 positioned within the tubing hanger (or BPV) profile 306 of the tubing hanger 304. As shown, when installed on the BPV rod 15 of the BPV lubrication tool 10, the BPV profile cleaning assembly 100 can be stung into the BPV profile 306 such that the brush 105 (and specifically the bristles 104) can come into contact with the BPV profile 306. The magnet 108, positioned on the BPV rod 15 (or the mounting rod 115) can be run through the BPV profile 306 (since the outer diameter 110 of the magnet 108 can be smaller than an inner diameter of the profile 306) and therefore be positioned downhole of the BPV profile 306 in the wellhead 300.

In an example operation, and with reference to FIGS. 2-4, the BPV profile cleaning assembly 100 can run into or otherwise be inserted into wellhead 300 on the BPV lubrication tool 10. For example, the BPV lubrication tool 10 can be installed (with the BPV profile cleaning assembly 100) on the wellhead 300 and pressure tested to ensure that the BPV lubrication tool 10 connections are properly sealed. Next, production tree valves on the wellhead 300 can be opened and the BPV profile cleaning assembly 100 can be stung or set into the wellhead 300 (for example, just uphole of the BPV profile 306). Next, the BPV rod 15 can be extended from the running and retrieving tool 12 so that the brush 105 is seated within the BPV profile 306 (and the magnet 108 is downhole of the BPV profile 306 in the wellhead 300). Next, the BPV rod 15 can be operated, such as rotated and/or reciprocated (serially or in parallel) so that the brush 105 rotates and/or reciprocates against the BPV profile 306 to clean the profile 306. Debris, such as metallic debris 402 and/or non-metallic debris 406 can be removed from the BPV profile 306 by the bristles 104 as the brush 105 moves within the BPV profile 306. In some aspects, some or all of the metallic debris 402 can be magnetically attracted to and attach to one or more of the magnets 106 (for later removal from the wellhead 300). Further, in some aspects, some or all of the metallic debris 402 can be magnetically attracted to and attach to one or more of the magnet 108 (for later removal from the wellhead 300). Non-metallic debris 406 can become attached to the bristles 104 and/or fall downhole through the wellhead 300.

Once the described cleaning operation is completed (for example, after operation of the BPV lubrication tool 10 for a particular time period), the BPV lubrication tool 10 can be pulled from the wellhead 300 along with the BPV profile cleaning assembly 100. The wellhead production tree valves can be closed and the fluid pressure can be bled into the BPV lubrication tool 10. The BPV lubrication tool 10 can then be uninstalled from the wellhead 300. Once uninstalled, the BPV profile cleaning assembly 100 can be removed from the BPV lubrication tool 10 and a back pressure valve (such as back pressure valve 200) can be installed on the BPV rod 15. The BPV lubrication tool 10 can then be reinstalled into the wellhead 300 so that the back pressure valve 200 can be installed in the BPV profile 306.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A back pressure valve (BPV) profile cleaning tool, comprising:

a brush assembly attached to a BPV rod of a BPV lubricator tool, the brush assembly comprising:

a core coupled to the BPV rod;

a brush that comprises a plurality of bristles coupled to the core, the brush further comprising an outer diameter sized for insertion into a BPV profile of a wellhead, and at least one first magnet comprising a plurality of magnet portions coupled to the core and interspersed within the plurality of bristles; and a second magnet attached to an end of the BPV rod, the second magnet comprising an outer diameter sized to fit through the BPV profile of the wellhead and smaller than an outer dimension of a BPV configured to couple to the BPV profile, the second magnet positioned on the BPV rod to capture debris downhole of the BPV profile during movement of the brush assembly to clean the BPV profile.

2. The BPV profile cleaning tool of claim 1, wherein the at least one first magnet comprises a plurality of first magnets.

3. The BPV profile cleaning tool of claim 2, wherein the plurality of first magnets comprise a plurality of ring magnets mounted on the core.

4. The BPV profile cleaning tool of claim 1, wherein the at least one first magnet is configured to attract metallic debris detached from the BPV profile by the brush.

5. The BPV profile cleaning tool of claim 4, wherein the plurality of bristles are metallic bristles.

6. The BPV profile cleaning tool of claim 5, wherein the second magnet is configured to attract at least some of the metallic debris detached from the BPV profile by the brush or bristle pieces broken off from at least one of the plurality of metallic bristles.

7. The BPV profile cleaning tool of claim 1, wherein the second magnet is configured to threadingly attach to the end of the BPV rod.

8. The BPV profile cleaning tool of claim 1, wherein the outer diameter of the second magnet is less than an outer diameter of a BPV configured to couple to the BPV profile.

9. The BPV profile cleaning tool of claim 1, wherein the brush assembly and the second magnet are configured to couple to the BPV rod with one or more threaded connections.

10. The BPV profile cleaning tool of claim 1, wherein the core is cylindrical.

11. The BPV profile cleaning tool of claim 10, wherein the at least one first magnet comprises a plurality of ring magnets that circumscribe the core.

12. The BPV profile cleaning tool of claim 11, wherein each of the plurality of ring magnets is coupled to the core between at least two of the plurality of bristles.

13. The BPV profile cleaning tool of claim 11, wherein the plurality of ring magnets comprise three ring magnets.

14. A downhole tool assembly, comprising:

a back pressure valve (BPV) lubricator tool that comprises a BPV rod; and a BPV profile cleaning tool, comprising:

a brush assembly attached to the BPV rod and comprising:

a core coupled to the BPV rod;

a brush that comprises a plurality of bristles, the brush further comprising an outer diameter sized for insertion into a BPV profile of a wellhead, and at least one first magnet comprising a plurality of magnet portions coupled to the core and interspersed within the plurality of bristles; and a second magnet configured to attach to an end of the BPV rod, the second magnet comprising an outer diameter sized to fit through the BPV profile of the wellhead and smaller than an outer dimension of a BPV configured to couple to the BPV profile, the second magnet positioned on the BPV rod to capture debris downhole of the BPV profile during movement of the brush assembly to clean the BPV profile.

15. The downhole tool assembly of claim 14, wherein the at least one first magnet comprises a plurality of first magnets.

16. The downhole tool assembly of claim 15, wherein the plurality of first magnets comprise a plurality of ring magnets mounted on the core.

17. The downhole tool assembly of claim 14, wherein the at least one first magnet is configured to attract metallic debris detached from the BPV profile by the brush.

18. The downhole tool assembly of claim 17, wherein the plurality of bristles are metallic bristles.

19. The downhole tool assembly of claim 18, wherein the second magnet is configured to attract at least some of the metallic debris detached from the BPV profile by the brush or bristle pieces broken off from at least one of the plurality of metallic bristles.

20. The downhole tool assembly of claim 14, wherein the brush assembly and the second magnet are configured to threadingly attach to the end of the BPV rod.

21. The downhole tool assembly of claim 14, wherein the outer diameter of the second magnet is less than an outer diameter of a BPV configured to couple to the BPV profile.

22. The downhole tool assembly of claim 14, wherein the core is cylindrical, and the at least one first magnet comprises a plurality of ring magnets that circumscribe the core.

23. The downhole tool assembly of claim 22, wherein each of the plurality of ring magnets is coupled to the core between at least two of the plurality of bristles.

24. The downhole tool assembly of claim 22, wherein the plurality of ring magnets comprise three ring magnets.

* * * * *